United States Patent [19]

Myers

[11] Patent Number: 4,639,154

[45] Date of Patent: Jan. 27, 1987

[54] DUAL STATION PRINTER MECHANISM

[75] Inventor: Charles M. Myers, Riverton, Wyo.

[73] Assignee: Eaton Corporation, Cleveland, Ohio

[21] Appl. No.: 742,331

[22] Filed: Jun. 7, 1985

[51] Int. Cl.[4] ..... B41J 15/22

[52] U.S. Cl. ..... 400/584; 400/605; 400/607; 400/608.1; 400/600.2

[58] Field of Search ..... 400/584, 588, 596, 605, 400/606, 607, 607.2, 608, 607.3, 608.1, 608.2, 600.1, 600.2, 600.4

[56] References Cited

U.S. PATENT DOCUMENTS

| | | | |
|---|---|---|---|
| 3,625,333 | 12/1971 | Contona et al. | 400/605 |
| 3,653,483 | 4/1972 | Contona et al. | 400/585 |
| 4,205,770 | 6/1980 | Wojdyla | 400/608.1 |
| 4,360,279 | 11/1982 | Sugiura | 400/600.2 |
| 4,417,517 | 11/1983 | Matsuda et al. | 400/605 |
| 4,439,051 | 3/1984 | Lawter | 400/605 |
| 4,448,559 | 5/1984 | Matsuda et al. | 400/600.2 |

FOREIGN PATENT DOCUMENTS

| | | | |
|---|---|---|---|
| 133922 | 1/1979 | German Democratic Rep. | 400/595 |
| 121085 | 9/1980 | Japan | 400/600.1 |
| 62176 | 5/1981 | Japan | 400/584 |
| 150583 | 11/1981 | Japan | 400/600.1 |
| 205182 | 12/1982 | Japan | 400/607.2 |

OTHER PUBLICATIONS

Kratzert, "Independent Dual Form Feed", IBM Technical Disclosure Bulletin, vol 20, No. 8, pp. 3179-3180.

*Primary Examiner*—William Pieprz

*Attorney, Agent, or Firm*—D. A. Rowe; A. E. Chrow

[57] ABSTRACT

A dual station printer mechanism (10) including a first feed roller (22), a second feed roller (24), drive means (16) having an output shaft (20) for driving the first and second feed rollers (22, 24) and coupling means in the form of one-way clutches (34, 36) for selectively coupling and decoupling the first and second feed rollers (22, 24) from the output shaft of the drive means. Mechanism (10) further preferably includes a first pressure roller (68) normally biased against first feed roller (22) and a second pressure roller (80) normally biased against second feed roller (24) for enabling effective movement of first and second data carriers respectively therebetween to a position between a printhead 70 and a print bar 72 at which printing occurs. Rollers (68, 80) are mounted such that a crank arm (82) can be rotated by an operator and cause roller (68) to respectively move away from roller (22) and roller (80) to respectively move away from roller (24) for a distance sufficient to enable insertion or removal of the first and second data carriers for effective operation of mechanism (10) preferably in conjunction with moving print bar (72) away from printhead (70) and a data carrier (120) away from print bar (72) during the rotation of crank arm (82).

4 Claims, 6 Drawing Figures

DUAL STATION PRINTER MECHANISM

BACKGROUND OF THE DISCLOSURE

The present invention relates to a dual station printer mechanism and more particularly to a dual station printer mechanism having a single drive means for selectively driving first and second feed rollers preferably in conjunction with means for facilitating insertion or removal of data carrier paper at each station for efficient operation of the mechanism.

PRIOR ART

Dual station printers are known in the art. Generally, the known two station printer mechanisms utilize a separate drive means for each of the feed rollers or feed mechanisms in the printer. Other known prior art dual station printers utilize a single drive means and a clutch or gear arrangement for driving the separate feed rollers. An example of this structure is disclosed in the Anderson U.S. Pat. No. 4,229,113, which discloses first and second drive rollers one of which includes a one-way clutch therein. The first drive roller is mounted on a common drive shaft with the second drive roller. A stepper motor rotates the drive shaft and effects rotation of both the first and second drive rollers when the drive shaft is rotated in a first direction. When the drive shaft is rotated in a second direction opposite to the first direction, only one of the drive rollers is rotated due to the one-way clutch disposed within the first drive roller. The Anderson structure, while an advancement over the prior art, does not allow both of the feed rollers to be selectively coupled and decoupled from the drive shaft. One of Anderson's feed rollers always rotates with the drive shaft and the other Anderson feed roller rotates only when the drive shaft is rotated in a particular direction. The Englund U.S. Pat. No. 4,167,345, and the Okabe U.S. Pat., No. 4,264,218, both disclose other known printer apparatus which include common driving means for driving such things as the cut-off devices, drive rollers and printhead.

SUMMARY OF THE INVENTION

The present invention relates to a new and improved dual station printer mechanism which includes first and second feed rollers for feeding first and second data carriers and wherein each of the first and second feed rollers is operable to be selectively coupled or decoupled from a common drive means.

The present invention relates to a new and improved dual station print mechanism which includes a first feed roller for feeding a first data carrier, a second feed roller for feeding a second data carrier and drive means having an output shaft for alternately driving the first and second feed rollers. The output shaft when rotated in a first direction by the drive means effects rotation of the first feed roller and is ineffective to effect rotation of the second feed roller. When the output shaft is rotated in a second direction, opposite to the first direction, it effects rotation of the second feed roller and is ineffective to effect rotation of the first feed roller.

Another provision of the present invention is to provide a new and improved dual station print mechanism including first and second feed rollers, drive means having an output shaft for driving the first and second feed rollers and coupling mean for selectively coupling and decoupling the first and second feed rollers from the output shaft of the drive means. The coupling means couples the first feed roller and the output shaft and decouples the second feed roller and the output shaft when the output shaft is rotated in a first direction and couples the second feed roller and the output shaft and decouples the first feed roller and the output shaft when the output shaft is rotated in a second direction, opposite the first direction.

A further provision of the present invention is to provide a new and improved dual station print mechanism which includes first and second feed rollers and which further includes first and second pressure rollers respectively biased against said first and second feed rollers for feeding respective first and second data carrier paper therebetween and which are mounted such that they can be respectively moved away therefrom manually by an operator for facilitating insertion or removal of said first and/or second data carrier paper from therebetween preferably where the first and second feed rollers is operable to be selectively coupled or decoupled from a common drive means.

DESCRIPTION OF SOME PREFERRED EMBODIMENTS

Figure 1:
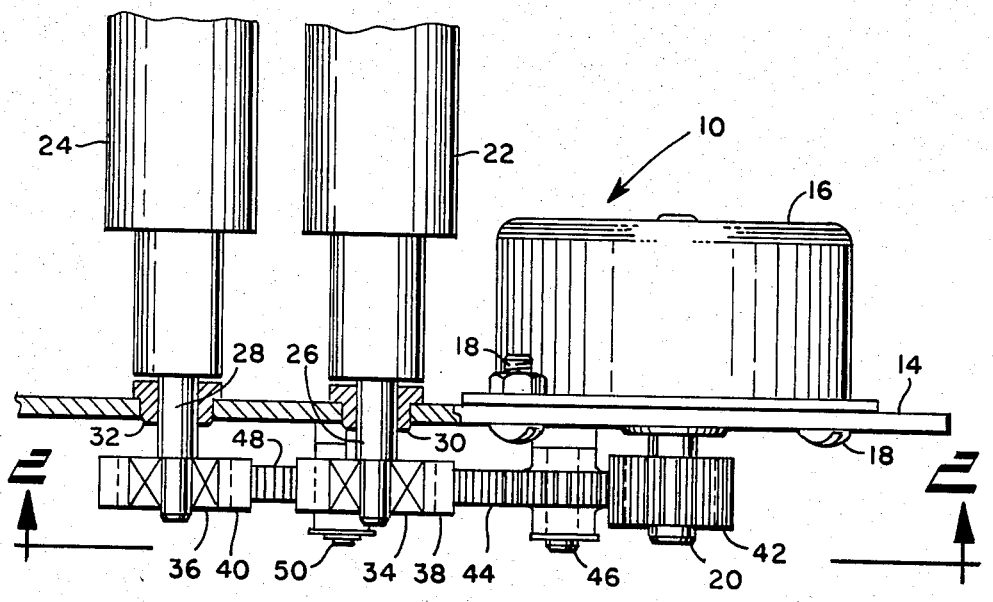
FIG. 1 is a fragmentary sectional top view of the dual station printer mechanism of the present invention.
Figure 2:
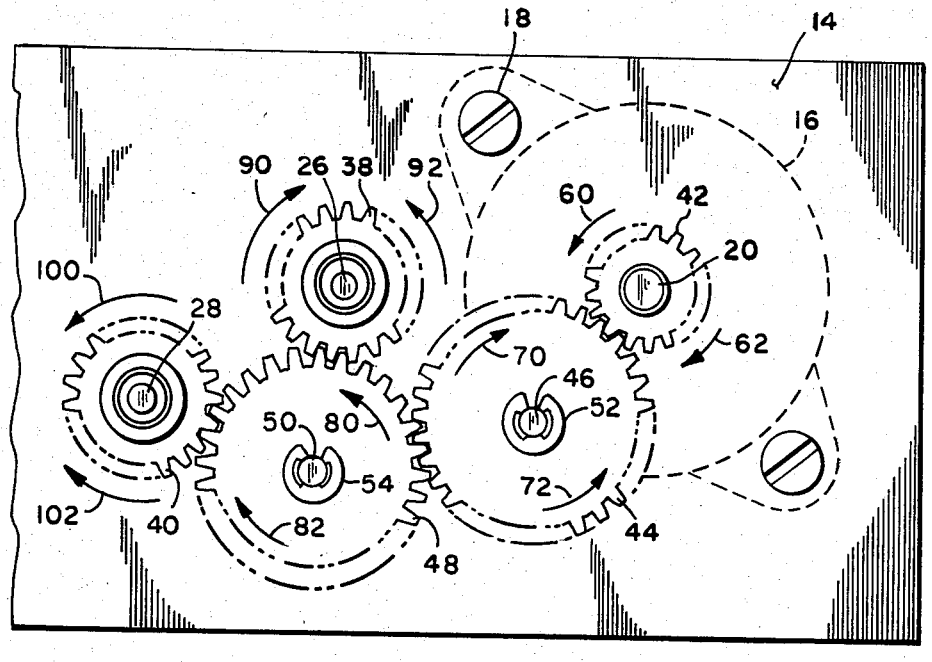
FIG. 2 is a fragmentary side view taken approximately along the lines 2—2 of FIG. 1 of the dual station printer mechanism of the present invention.

The dual station printer mechanism 10 illustrated in FIGS. 1 and 2 includes a frame 14 which supports drive means in the form of stepper motor 16. Stepper motor 16 is secured to frame 14 by a plurality of bolts 18. Stepper motor 16 includes an output shaft 20 which is adaptable to drive a pair of feed rollers 22, 24 which are supported on shafts 26, 28, respectively. Feed rollers 22 and 24 are each adapted to be associated with a pressure roller, not illustrated, in a well known manner to effect feeding of a paper data carrier such as a roll of paper or a form on which it is desired to print. As used herein, "first and second data carriers" includes applications where both are in the form of paper respectively fed from rolls and where one or both are in the form of sheets of paper fed by hand and where one or both are by nature forms fed either from a roll or by hand. For example, roller 22 can feed the data carrier from a continuous roll of paper and roller 24 could be utilized to feed a form which was manually inserted between roller 24 and its associated pressure roller. The form could be selectively placed between form feed roller 24 and its associated pressure roller. Thus, the dual station printer preferably includes a first printing station associated with the roll paper feed roller 22 and a second printing station associated with the form feed roller 24. A printhead mechanism, such as the printhead mechanism disclosed in the Cranston U.S. Pat. No. 4,367,964, incorporated herein by references, can be utilized to drive a printhead adjacent the rollers 22 and 24 to effect printing on the data carrier in a well known manner.

Shaft 26, which supports feed roller 22, is supported within a bushing 30 supported in an opening of frame 14 and shaft 28, which supports roller 24, is supported within a bushing 32 also supported in an opening of frame 14. Coupling means are provided for selectively coupling and decoupling feed rollers 22 and 24 with output shaft 20 of stepper motor 16. The coupling means comprises respective one-way clutches 34 and 36 which are associated with feed rollers 22 and 24 respectively. One-way clutch 34 includes an input member 38 which in the preferred embodiment is a pinion gear and an output member which includes shaft 26. One-way clutch 36 includes an input member 40 which comprises a pinion gear and an output member which includes shaft 28. The one-way clutches 34 and 36 are operable to selectively drive rollers 22 and 24 as will be explained more fully herein below.

Output shaft 20 of stepper motor 16 has a pinion gear 42 supported thereon. Pinion gear 42 is operable to mesh with a first idler gear 44 which is supported on a shaft 46 for rotation. Shaft 46 is supported by frame 14 and an E-clip or retaining ring 52 can be disposed on the end of shaft 46 in a well known manner to locate idler gear 44 thereon. A second idler gear 48 is supported on a shaft 50 which is also supported by frame 14. An E-clip 54 can be disposed on the end of shaft 50 to secure idler gear 48 to shaft 50.

Pinion 42 is operable to rotate upon energization of stepper motor 16 and rotation of output shaft 20. Pinion 42 is in meshing engagemen with first idler gear 44 and rotation of pinion 42 effects rotation of idler gear 44. First idler gear 44 is in meshing engagement with second idler gear 48 and rotation of idler gear 44 will effect rotation of idler gear 48. Idler gear 48 is in meshing engagement with pinion gears 38 and 40 and rotation of idler gear 48 effects rotation of both the pinion gears 38 and 40. If pinion gears 38 and 40 are rotated in the proper direction, as will be described hereinafter, rotation of output shafts 26 and 28 can be effected to effect rotation of feed rollers 22 and 24 and thus feeding of the first and second data carriers. The direction of rotation of pinion gears 38 and 40 is controlled by the direction of rotation of output shaft 20 of stepper motor 16. While the present embodiment has been illustrated as utilizing idler gears 44 and 48 to interconnect output shaft 20 with pinion gears 38 and 40, it should be appreciated that other embodiments could be utilized which eliminate idler gears 44 and 48 and directly connect output shaft 20 to pinion gears 38 and 40.

Output shaft 20 of stepper motor 16 is operable to rotate in a first counterclockwise direction as is illustrated by the arrow 60 is FIG. 2. Rotation of pinion 42 in the first direction will effect rotation of first idler gear 44 in the direction of arrow 70. Rotation of first idler gear 44 in the direction of arrow 70 will effect rotation of second idler gear 48 in the direction of arrow 80. Rotation of second idler gear 48 in the direction of arrow 80 will effect rotation of pinion 38 in the direction of arrow 90 and pinion 40 in the direction of arrow 102. Rotation of pinion 38 in the direction of arrow 90 will effect rotation of output shaft 26 of the one-way clutch 34 in the direction of arrow 90 and rotation of feed roller 22 in the direction of arrow 90. Rotation of pinion 40 in the direction of arrow 102 will be ineffective to effect rotation of shaft 28 which supports feed roller 24 due to one-way clutch 36. Thus, rotation of motor output shaft 20 in the first direction as indicated by arrow 60 will effect rotation of feed roller 22 but will not effect rotation of feed roller 24.

Output shaft 20 of motor 16 is also operable to be rotated in a clockwise direction as indicated by arrow 62. Clockwise rotation of pinion 42 will effect counterclockwise rotation of first idler gear 44 in the direction of arrow 72. Rotation of idler gear 44 in the direction of arrow 72 will effect rotation of idler gear 48 in the direction of arrow 82. Rotation of idler gear 48 in the direction of arrow 82 will effect rotation of pinion 40 in the direction of arrow 100 and pinion 38 in the direction of arrow 92. Rotation of pinion 40 in the direction of arrow 100 will effect rotation of output shaft 28 of one-way clutch 36 and rotation of feed roller 24 in the direction of arrow 100. Rotation of pinion 38 in the direction of arrow 92 will be ineffective to effect rotation of shaft 26 and feed roller 22 due to the decoupling action of one-way clutch 34. Thus, when output shaft 20 of the stepper motor 16 is rotated in the counterclockwise direction, one-way clutch 36 will couple shaft 28 to shaft 20 to effect rotation of feed roller 24 while one-way clutch 34 decouples shaft 26 and feed roller 22 will not rotate. It should be appreciated that one-way clutches 34 and 36 act to selectively couple and decouple first and second feed rollers 22 and 24 with output shaft 20 of stepper motor 16 depending upon the direction of rotation of output shaft 20. Additionally, when the output shaft 20 is rotated, one of feed rollers 22 and 24 will always be rotated. Hence, the drive motor will be operable to supply substantially constant torque on the driven roller due to the fact that one roller will always be driven when motor 16 is energized. This is in contrast to prior art drivers where the drive motor sometimes operates one roller and other times operates two rollers and hence divides its torque therebetween.

Dual station printer mechanism 10 is preferably adapted to support a paper supply mandrel 60 which supports a roll of supply paper 62. The paper from the roll of paper 62 is directed around a paper supply post 66 and passes between paper feed roller 22 and a paper pressure roller 68. A printhead 70 is disposed in a facing relationship to a print bar 72 which is in part supported by frame 14 and a solenoid assembly 74. Printhead 70 is adapted to print, in a well known manner, on paper which passes between the end of printhead 70 and print bar 72. A data carrier drag 120 hereinafter described is provided. between feed roller 22 and print bar 72 on which paper 62 slides as it is fed to print bar 72 by feed roller 22. A ribbon cartridge 76 is mounted on frame 14 and another frame member not shown and includes a ribbon therein for allowing the printhead to print on the paper passing between printhead 70 and print bar 72.

As can be seen from FIGS. 3 and 4A–4C, printer mechanism 10 includes a first feed roller 22 which preferably cooperates with pressure roller 68 to provide a first feed path for a first data carrier between print bar 72 and printhead 70. The second feed or form feed roller 24 cooperates with a pressure roller 80 to define a second feed path for feeding a second data carrier between printhead 70 and print bar 72. In the present embodiment, the first data carrier is the roll of paper 62 which passes around paper supply post 66, between feed roller 22 and pressure roller 68 and between printhead 70 and printbar 72. For all practical purposes, in the preferred embodiment, paper 62 always passes between the print bar 72 and printhead 70 except when the roll of paper 62 is used up. Feed roller 24 and pressure roller 80 provide a second path for feeding a second data carrier between print bar 72 and printhead 70. The second data carrier is intermittently placed between feed roller 24 and pressure roller 80 to effect simultaneous printing on the first data carrier in the form of paper and the second data carrier which, in the preferred instance, is an insertable paper form.

In addition to the singular powered roller form and paper driving arrangement hereinbefore described, it is desirable to be able to move pressure roller 80 relative to the feed roller 24 to create a gap therebetween for insertion of a form therebetween when it is also desired to print on the form. In addition, it is desirable to be able to move printhead 70 relative to print bar 72 to space print bar 72 apart from the printhead 70 to allow the first and second data carriers to initially pass between the print bar 72 and printhead prior to initiating the printing operation. The means by which such is accomplished is provided by an elongate crank member 82 having a plurality of eccentric lobes or cam portions and which may be manually rotated to move pressure roller 80 relative to feed roller 24, and pressure roller 68 relative to feed roller 22 preferably in conjunction with moving print bar 72 relative to printhead 70 and data carrier drag 120 relative to print bar 72. Additionally, solenoid 74 is preferably included and operable to be energized to raise print bar 72 in an upwardly direction as is viewed in FIG. 4B as will be more fully described hereinbelow.

Figure 3:
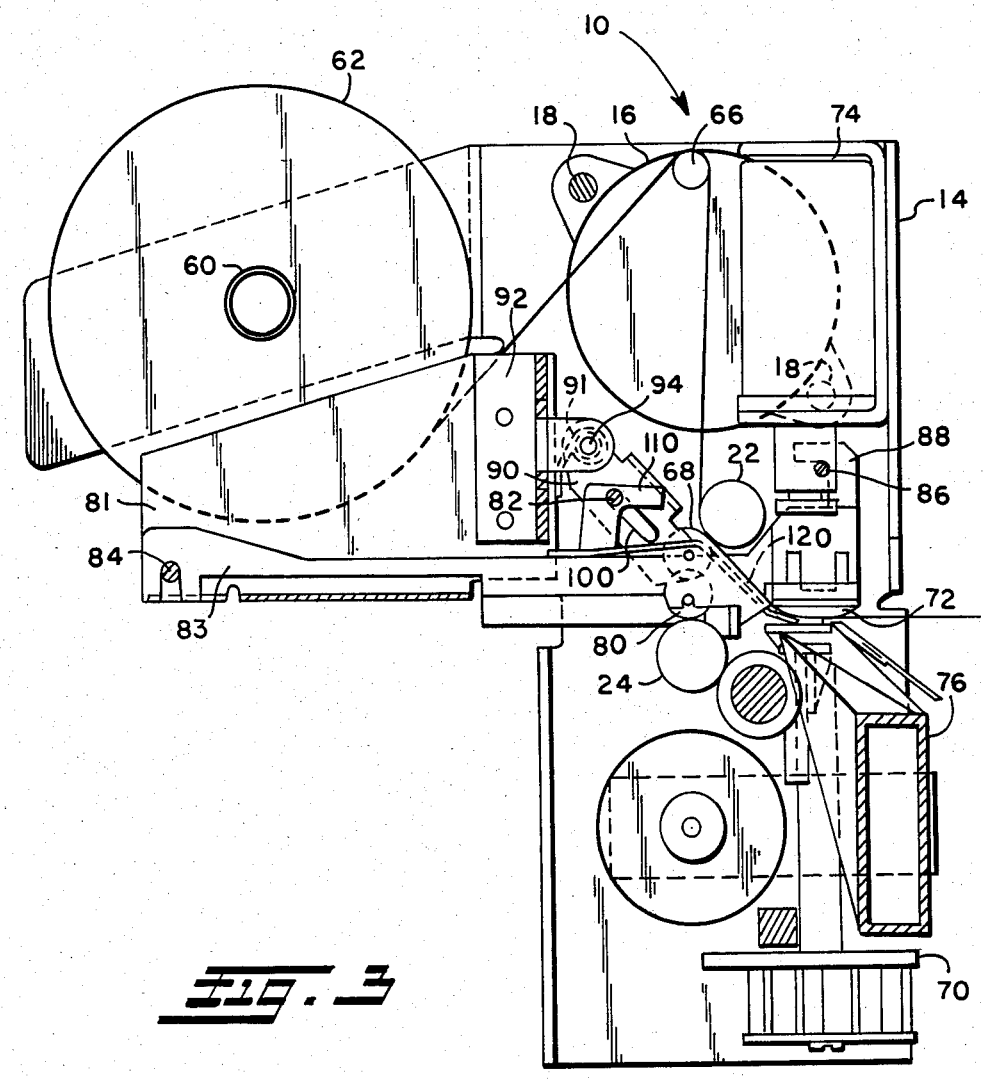
FIG. 3 is a left side elevated view of the mechanism of FIGS. 1 and 2.
Figure 4A:
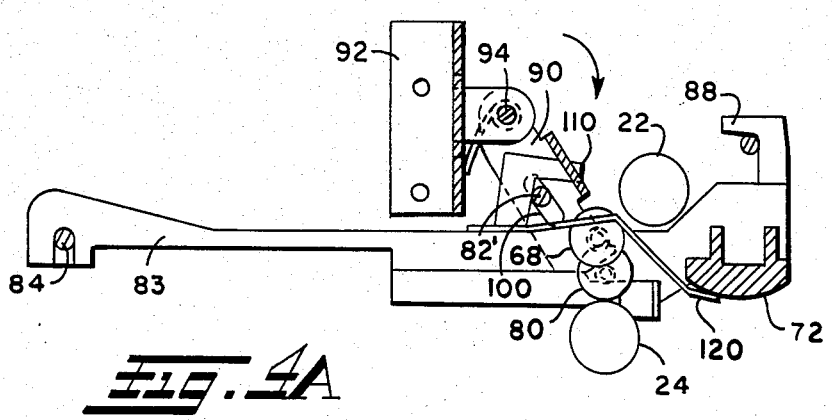
FIGS. 4A, 4B and 4C are partial side elevation views showing the sequence by which the mechanism of the invention is able to facilitate data carrier insertion and removal.
Figure 4B:
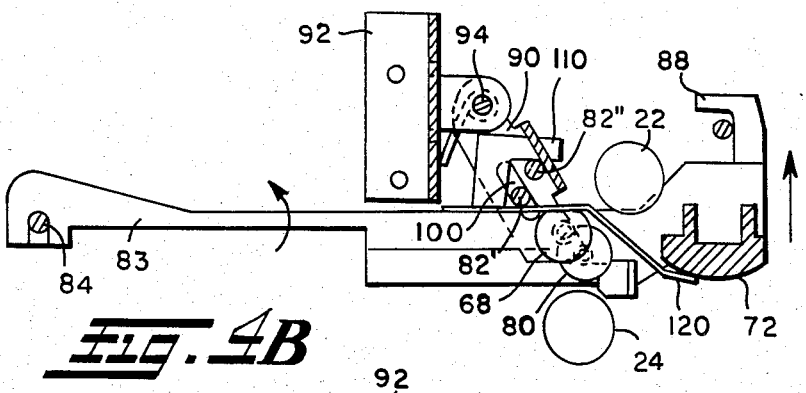
Figure 4C:
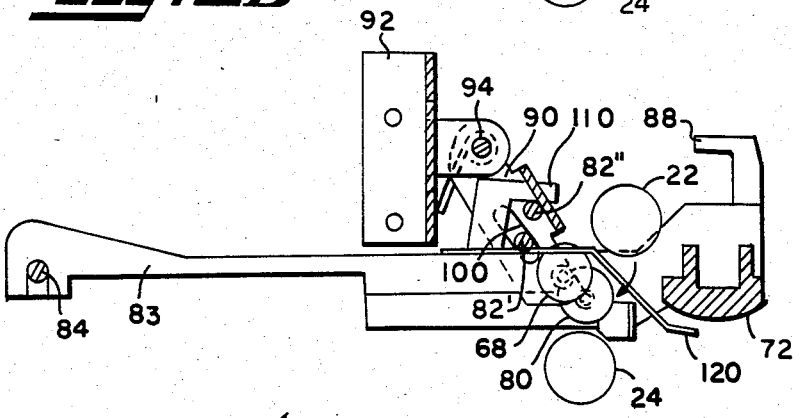

As shown in FIG. 3, a compensator frame 83 is supported for rotation about a compensator shaft 84 supported by frame 14 of printer mechanism 10. Pressure roller 80 is supported on compensator frame 83 and movement of compensator frame 83 about compensator shaft 84 will effect relative movement of pressure roller 80 toward and away from feed roller 24. Compensator frame 83 preferably includes a hook 88 at the end thereof as shown in FIGS. 4A, 4B and 4C. A pin 86 disposed on solenoid 74 engages with a hook 88. Print bar 72 is normally biased downwardly toward printhead 70 by a coiled spring or other suitable biasing means. Print bar 72 is operatively coupled with solenoid 74 and activation of solenoid 74 urges print bar 72 upwardly away from printhead 70. Understandably, a reverse arrangement would be equally suitable where print bar 72 is normally biased upwardly away from printhead 70 and hook 88 is shaped to press upwardly against pin 86 and move print bar 72 downwardly and toward printhead 70 in response to counter-clockwise rotation of frame 83. Rotation of compensator frame 83 about compensator shaft 84 enables compensator pin 86 to move upwardly and thereby enable solenoid 74 and print bar 72 to move upwardly relative to printhead 70. Movement of compensator frame 83 will operate to space apart feed roller 24 relative to pressure roller 80 and print bar 72 relative to printhead 70.

A pressure frame 90 is supported by a pressure frame bracket 92 which is attached to the frame 14 of mechanism 10 by means of compensator bracket 81 shown in FIG. 3. Pressure frame 90 is adapted to rotate about pivot shaft 94 supported by pressure bracket 92. Pressure frame 90 supports pressure roller 68 and is operable to effect movement of pressure roller 68 relative to feed roll 22. Pressure frame 90 is biased in a counterclockwise direction by means of torsion spring 91 having one end secured to pressure frame 90 and an opposite end pressing against bracket 92. In FIG. 3, crank 82 is in an initial condition with rollers 24 and 80 pressed firmly together and with frame 90 pressing roller 68 firmly against roller 22 by means of torsion spring 91.

Pressure frame 90 includes an elongate slot 100 disposed therein. Slot 100 is, adapted to receive crank 82. Crank 82 is operable to rotate and includes an eccentric first lobe or cam portion 82′ spaced apart from a second lobe or cam portion 82″ hereinafter described with respect to FIGS. 4A–4C.

Cam portions 82′ and 82″ of crank 82 are preferably sequentially operable upon rotation of crank 82 to: first move roller 68 away from roller 22; to then move roller 80 away from roller 24 preferably in conjunction with moving print bar 72 away from printhead 70; and preferably to then move a data carrier drag 120 away from print bar 72 to facilitate removal or insertion of the first data carrier between rollers 22 and 68 and the second data carrier between rollers 24 and 80. Crank 82 and the hereinafter described components of mechansim 10 with which cam portions 82′ and 82″ respectively engage provides the sequential opening functions described herein upon counterclockwise rotation of crank 82 preferably within less than 180 degrees of rotation. It is to be understood that adaptations altering the sequence under counterclockwise rotation of crank 82 or to provide the same or an altered sequence of opening functions upon clockwise rotation of crank 82 a greater or lesser amount than 180 degrees of rotation is considered within the scope of the invention.

Cam portion 82′ of crank 82 is disposed within slot 100 of pressure frame 90. Cam portion 82′ preferably extends radially from the central rotational axis of crank 82 for a distance such that an approximate 20 degree counterclockwise rotation of crank 82 causes cam portion 82′ to press downwardly against the left hand edge of frame 90 bordering slot 100 and urge frame 90 in a clockwise direction as shown by the arrow in FIG. 4A. Roller 68 is carried by frame 90 and clockwise rotation of frame 90 causes roller 68 to move away from roller 22 a distance sufficient to insert the first data carrier therebetween.

As shown in FIG. 4B, further counterclockwise rotation of crank 82 to about 90 degrees causes cam portion 82′ to move downwardly further along slot 100 whilst at the same time rotating cam portion 82″ against hook 110 secured to compensation frame 83 which is pivotly mounted to shaft 84 at one end. The upwards movement of cam portion 82″ against hook 110 causes frame 83 to rotate counterclockwise as shown by the arrow in FIG. 4B. Roller 80 is carried by frame 83 and the counterclockwise rotation of frame 83 is adapted to move roller 80 away from roller 24 a distance sufficient to remove or insert the second data carrier between rollers 24 and 80.

As previously described, print bar 72 is normally biased toward printhead 70 by a coiled spring or other suitable means not shown. The counterclockwise rotation of frame 83 in FIG. 4B also moves print bar 72 away from printhead 70.

Finally, further counterclockwise rotation of crank 82, as shown in FIG. 4C, preferably causes cam portion 82′ to rotate against drag 120 which is secured to frame 83 and cause drag 120 to move downwardly away from print bar 72 as shown by the arrow in FIG. 4C.

In addition to the ability of the coaction between hook 110 and cam portion 82″ to move print bar 72 towards and away from printhead 70 by rotation of crank 82 as previously described, mechanism 10 is preferably provided with solenoid 74 that is operable to effect upward movement of print bar 72 away from the printhead 70 as previously described. This is particularly desirable when a form is manually inserted between the form feed roller 24 and form pressure roller 80. Solenoid 74 could be manually operated via a switch or could be operated via a sensor which would sense when it was desired to insert a form between the print bar 72 and printhead 70. When solenoid 74 is actuated its armature will move away from printhead 70 thereby moving print bar 72 away from printhead 70. The solenoid and compensator mechanisms described herein allow forms and rolls of paper to be easily inserted and loaded in the printing mechanism. Additionally, compensator frame 83 is resiliently biased in a clockwise direction which allows different thickness papers and forms to be utilized in the present mechanism.

From the foregoing, it should be apparent that a new and improved dual station printer mechanism has been provided which includes a first feed roller 22 for feeding a first data carrier to a position between print bar 72 and printhead 70 at which the data carrier can be printed, a second feed roller 24 for feeding a second data carrier to a position between print bar 72 and printhead 70 at which the second data carrier can be printed, drive means 16 having an output shaft 20 for driving the first and second feed rollers and coupling means in the form of one-way clutches 34 and 36 for selectively coupling and decoupling the first and second feed rollers from the output shaft of the drive means. The one-way clutches act to couple the first feed roller 22 and the output shaft 20 and decouple the second feed roller 24 and the output shaft 20 when the output shaft is rotated in a first direction and act to couple the second feed roller 24 and the output shaft 20 and decouple the first feed roller 22 and output shaft 20 when the output shaft is rotated in a second direction, opposite the first direction preferably in conjunction with the crank operated means for facilitating insertion or removal of the first and second data carriers as hereinbefore described.

What I claim is:

1. A dual station printer mechanism comprising a driven first feed roller having a first pressure roller biased thereagainst for feeding a first data carrier therebetween to a position between a print bar and a printhead at which said data carrier can be printed, a driven second feed roller having a second pressure roller biased thereagainst for feeding a second data carrier therebetween to a position between a print bar and a printhead at which said second data carrier can be printed, and a singular elongate crank arm mounted for rotation by an operator and having spaced-apart first and second cam portions therealong, said first and second pressure rollers rotatably mounted on respective mountings adapted such that rotation of the crank arm causes said first cam portion to press against said first pressure roller mounting and move said first pressure roller away from said first feed roller a distance sufficient to remove or insert said first data carrier therebetween and causes said second cam portion to press against said second pressure roller mounting and move said second pressure roller away from said second feed roller a distance sufficient to remove or insert said second data carrier therebetween and said crank arm including means operative upon rotation thereof to move the print bar away from the print head a distance sufficient to enable insertion or removal of the first and second data carriers from therebetween.

2. The mechanism of claim 1 further including a data carrier drag member disposed between said print bar and said printhead on which at least said first data carrier slides to said printing position therebetween and said crank arm is operative upon rotation to move said drag member away from said print bar for a distance sufficient to enable removal or insertion of said first data carrier therebetween.

3. A dual station printer mechanism as defined in claim 1 or 3 wherein said first feed roller drive means includes a first pinion gear, a first one-way clutch means having an input member which includes said first pinion gear and a first output member for driving said first feed roller and said second feed roller drive means includes a second one-way clutch means having an input member which includes a second pinion gear and a second output member for driving said second feed roller.

4. The mechanism of claim 1 wherein the means for moving said print bar away from said printhead is provided by the movement of said second cam portion of said crank arm against said second pressure roller mounting.

* * * * *